United States Patent [19]

Brewer et al.

[11] 4,360,112

[45] Nov. 23, 1982

[54] TWO-WAY EXTENDABLE CRANE TROLLEY

[75] Inventors: Bruce L. Brewer, Alliance; Brooks E. Weingart, Sebring, both of Ohio

[73] Assignee: AMCA International Corporation, Hanover, N.H.

[21] Appl. No.: 191,280

[22] Filed: Sep. 26, 1980

[51] Int. Cl.[3] ..... B66C 9/02

[52] U.S. Cl. ..... 212/206; 105/163 R; 105/393; 212/210; 212/221; 254/285; 254/399

[58] Field of Search ..... 212/205, 210, 216, 217, 212/220, 221, 142.1, 206; 280/638; 105/163 R, 163 SK, 393; 294/81, 81 SF; 254/281, 285, 327, 337, 399; 414/460

[56] References Cited

U.S. PATENT DOCUMENTS

| | | | |
|---|---|---|---|
| 3,009,583 | 11/1961 | Pierson | 212/210 X |
| 3,297,170 | 1/1967 | McCready et al. . | |
| 3,458,229 | 7/1969 | Nagy et al. | 294/81 SF |
| 3,727,778 | 4/1973 | Hollenback . | |
| 3,784,028 | 1/1974 | Stewart . | |
| 3,854,592 | 12/1974 | Mordre | 212/210 |
| 3,895,818 | 7/1975 | Fearon . | |

*Primary Examiner*—Robert G. Sheridan

*Attorney, Agent, or Firm*—Maky, Renner, Otto & Boisselle

[57] ABSTRACT

A two-way horizontally extendable trolley 22 comprising a trolley frame 51 and wheels 52 for supporting trolley frame 51, a first horizontally elongated trailer frame 54 slidably mounted on frame 51, and a second horizontally elongated trailer frame 55 slidably mounted on trolley frame 51, said trailer frames 54 and 55 each having a first end extending beyond an end of frame 51, and auxiliary wheels 56 and 57, respectively, for supporting said first ends. Trolley 22 includes: means for horizontally extending trailer frames 54 and 55 outwardly from the trolley frame 51 and retracting trailer frames 54 and 55 inwardly toward trolley frame 51; hoisting means mounted on trolley frame 51; auxiliary hoisting means mounted on trailer frames 54 and 55; and means for driving wheels 52. Crane 10 for use with trolley 22 is also disclosed.

32 Claims, 8 Drawing Figures

TWO-WAY EXTENDABLE CRANE TROLLEY

TECHNICAL FIELD

This invention relates generally to cranes, and in particular to trolleys mounted on cranes for transporting articles of varying shapes and sizes. Specifically, the invention relates to a multi-functional horizontally extendable crane trolley that is suitable for hoisting and transporting relatively compact articles and, alternatively, elongated articles.

BACKGROUND OF THE INVENTION

In the operation of various types of storage facilities such as, for example, the warehouse of a metal fabricating plant or the loading platform of a wharf, it often happens that cranes are required to hoist and transport articles of greatly varying shapes and sizes. For example, in the operation of a metal fabricating plant, a crane may be required in one instance to hoist and transport a box or a load of relatively compact articles having typical dimensions of, for example, 4×4×6 feet, and in another instance be required to hoist and transport an elongated article such as a steel plate or a girder having a length of perhaps 50 feet or more. Present day storage facilities generally employ one of several different approaches to the design of cranes required to perform such multiple functions. One of these approaches is to use a crane with two or three trolleys mounted for travel along its bridge. Such cranes may consist of, for example, four-girder bridge cranes with a larger trolley mounted on the two outside girders and a smaller trolley, which operates underneath the larger trolley, mounted on the two inside girders. Alternatively, two, three or more trolleys are mounted for operation on the same set of girders. In either case, the trolleys are operated in tandem when elongated loads are hoisted and transported, one trolley, for example, hoisting one side of the article and another trolley hoisting the other side. An alternative approach is to simply employ two or three cranes such that when elongated loads must be hoisted and transported, the cranes are operated in tandem. Each of these approaches has disadvantages which include relatively high costs of installation and complex operating procedures.

SUMMARY OF THE INVENTION

Cranes that employ the multi-functional two-way extendable trolley of the type illustrated in the drawings and hereinafter described, can be used to hoist and transport both relatively compact articles and elongated articles without the necessity of employing a crane using two or more trolleys mounted on its bridge, or two or more cranes. Broadly stated, the invention contemplates a two-way extendable trolley comprising a trolley frame and wheel means for supporting said trolley frame, a first horizontally elongated trailer frame slidably mounted on said trolley frame, said first trailer frame having a first end extending beyond a first end of said trolley frame and first auxiliary wheel means for supporting said first end of said first trailer frame, and a second horizontally elongated trailer frame slidably mounted on said trolley frame, said second trailer frame having a first end extending beyond a second end of said trolley frame and second auxiliary wheel means for supporting said first end of said second trailer frame, said first end and said second end of said trolley frame being disposed opposite each other, said first trailer frame and said second trailer frame being adapted for extending in opposite directions from each other.

Advantageously, the trolley of the present invention includes means for horizontally extending said first trailer frame and second trailer frame outwardly from said trolley frame and retracting said first trailer frame and second trailer frame inwardly toward said trolley frame, hoisting means mounted on said trolley frame, a first auxiliary hoisting means mounted on said first trailer frame and a second auxiliary hoisting means mounted on said second trailer frame, and means for driving said wheel means for supporting said trolley frame. In a preferred embodiment, each of the first and second trailer frames comprises a pair of horizontally elongated parallel spaced frame members connected to each other by cross-member means. In a particularly advantageous and, therefore, greatly preferred embodiment, the cross-member means of said first trailer frame comprises a first pair of horizontally elongated parallel spaced underslung beams fixedly attached to and disposed at right angles to the frame members of said first trailer frame, and said cross-member means of said second trailer frame comprises a second pair of horizontally elongated parallel spaced underslung beams fixedly attached to and disposed at right angles to the frame members of said second trailer frame.

Further, the invention contemplates a crane comprising a horizontally elongated bridge, means for supporting said bridge, and a two-way extendable trolley mounted on said bridge and adapted for horizontal travel along said bridge, said trolley including a trolley frame, wheel means for supporting said trolley frame, a first horizontally elongated trailer frame slidably mounted on said trolley frame, said first trailer frame having a first end extending beyond a first end of said trolley frame and first auxiliary wheel means for supporting said first end of said first trailer frame, and a second horizontally elongated trailer frame slidably mounted on said trolley frame, said second trailer frame having a first end extending beyond a second end of said trolley frame and second auxiliary wheel means for supporting said first end of said second trailer frame, said first end and said second end of said trolley frame being disposed opposite each other, said first trailer frame and said second trailer frame being adapted for extending in opposite directions from each other.

DETAILED DESCRIPTION OF THE PREFERRED EMBODIMENT

Figure 1:
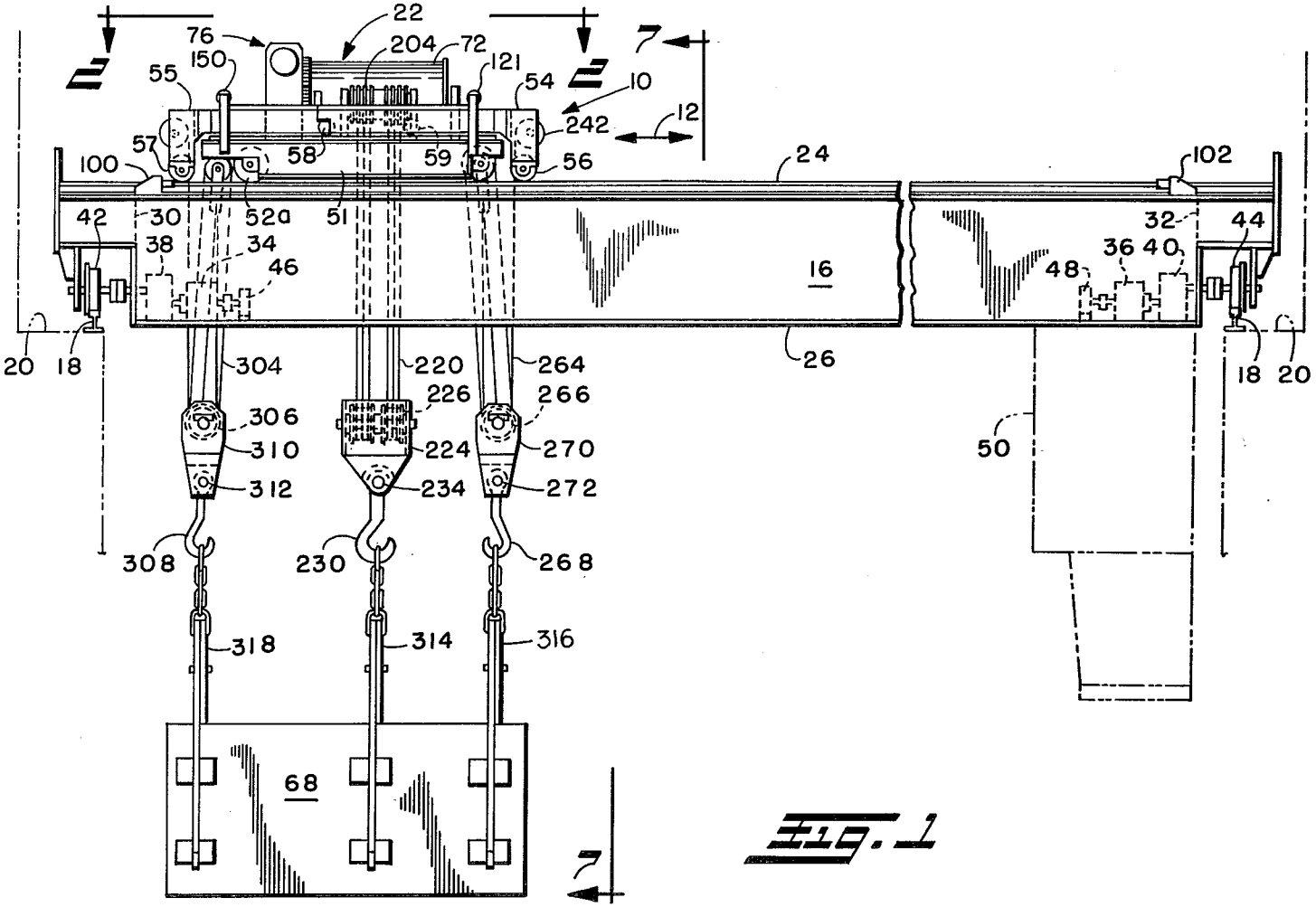
FIG. 1 is a partial elevational view of a crane embodying the present invention in a particular form, with the trolley of the present invention in a horizontally retracted mode.

The crane of the present invention in its illustrated embodiment, as mounted, for example, for overhead travel, comprises (FIG. 1) an overhead traveling crane indicated generally by the reference numeral 10 which has provision for both longitudinal and transverse horizontal movements at right angles to one another, as indicated by directional arrows 12 and 14, so that the article being transported can be lifted and deposited at any point within the rectangle covered by the movement of crane 10. Crane 10 comprises bridge 16 which is adapted for spanning, for example, the floor of a warehouse or the loading platform of a wharf, moves transversely along horizontally elongated overhead parallel tracks 18 which are mounted, for example, on building structure 20; and a horizontally extendable trolley which is indicated generally by the reference numeral 22 and is adapted for longitudinal movement along tracks 24 which are mounted on bridge 16. It is to be understood, however, that any crane that is suitable for use with a crane trolley can be used in combination with the horizontally extendable trolley of the present invention. Such cranes include, for example, polar cranes, and rotating bridge cranes pinned at one end on a vertical axis with the other end mounted for rotational movement on circular or arcuate track. A gantry crane, which is similar in construction and design to overhead traveling crane 10 except that the overhead bridge is carried at each end by a vertically elongated trestle which travels along tracks mounted on the ground, can also be used in accordance with the present invention. In some instances an overhead crane supported at one end by an overhead track mounted, for example, on the side of a building structure and supported at the other end by a vertically elongated trestle traveling on tracks mounted on the ground, can also be used in accordance with the present invention.

Bridge 16 is a horizontally elongated rectangular frame comprising horizontally elongated parallel girders 26 and 28 connected by end-ties 30 and 32. Girders 26 and 28 are sufficiently elongated to traverse the ground or floor area to be serviced by crane 10. End-ties 30 and 32 are smaller than girders 26 and 28 but are sufficiently elongated to provide structural stability to crane 10 and to provide an open area between girders 26 and 28 to allow for the movement and operation of trolley 22. Bridge 16 preferably has a walkway or platform (not shown) to provide for the servicing, repair and oiling of the bridge and trolley. The movement of bridge 16 along tracks 18 is accomplished by the operation of electric motors 34 and 36 which are mounted on girder 26. Motors 34 and 36 rotatably engage gear reducers 38 and 40, which drive wheels 42 and 44, respectively. Gear reducers 38 and 40 are also mounted on girder 26. Electrically operated brakes 46 and 48 are mounted on girder 26 and aligned with motors 34 and 36, respectively, and are used to reduce or stop the rotation of the armatures of such motors. Wheels 42 and 44 each comprise a set of four wheels rotatably mounted for travel along tracks 18. In the illustrated embodiment, only one wheel of each set of wheels is actually driven, the others follow the driven wheel and provide the bridge with support. More wheels, for example eight wheels or fewer wheels, could be provided at each end of bridge 16 depending upon the anticipated loads to be handled by crane 10. The movements of bridge 16 as well as trolley 22 are activated and controlled from operator cage 50 which is welded or bolted to and depends from the bottom of girder 26 and comprises a central location for all the controls and switchboards necessary to activate and control each and every movement of the bridge and trolley.

Trolley 22 comprises a substantially rectangular trolley frame 51 mounted on wheels 52 and adapted for longitudinal horizontal movement in the direction indicated by directional arrow 12 along tracks 24, a first horizontally elongated trailer frame 54 which is slidably mounted on trolley frame 51 and supported at one end by wheels 56 and at the other end by wheels 58, and a second horizontally elongated trailer frame 55 which is slidably mounted on trolley frame 51 and supported at one end by wheels 57 and the other end by wheels 59. Wheels 56 and 57 are adapted for travel along tracks 24. Wheels 58 and 59 are adapted for travel along horizontally elongated parallel tracks 60 and 61, respectively, which are mounted on frame 51 and extend horizontally in the direction indicated by directional arrow 12. Trolley 22 is adapted for operating in a retracted mode (FIG. 1) for hoisting and transporting relatively compact articles such as, for example, box 68 and for operating in an extended mode (FIG. 8) for hoisting and transporting relatively elongated articles such as, for example, tubular member 70, all as hereinafter explained.

Trolley frame 51 is sufficiently elongated to span the opening between girders 26 and 28 and sufficiently elongated to support lifting barrels 72 and 74, the drive assembly indicated generally by the reference numeral 76 for rotating such barrels, the drive assemblies indicated generally by the reference numerals 78 and 79 for extending and retracting trailer frames 54 and 55, respectively, and the drive assembly indicated generally by the reference numeral 80 for driving trolley 22 along tracks 24. Each of the girders 26 and 28 have one of the parallel tracks 24 mounted on it.

Figure 2:
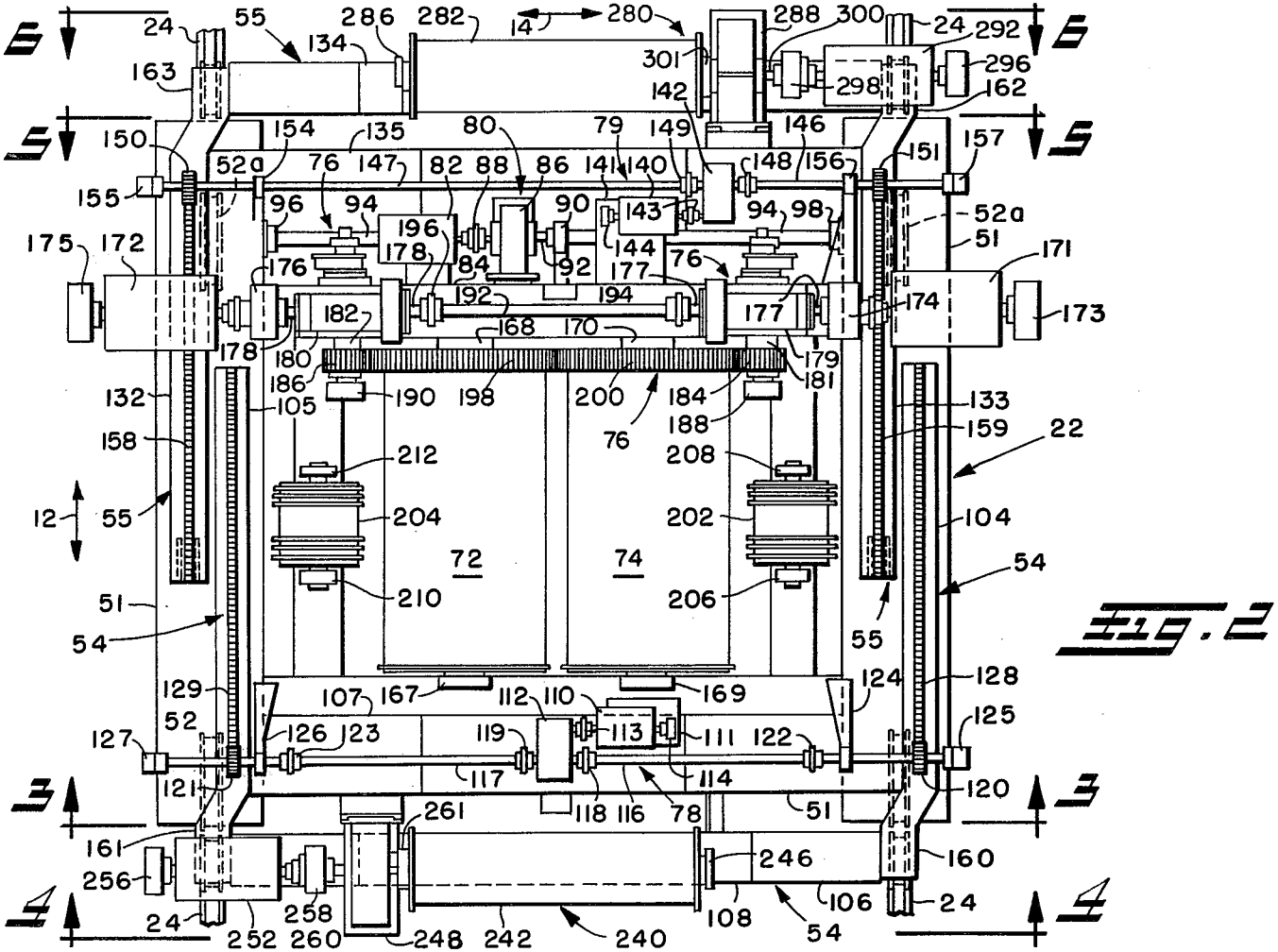
FIG. 2 is an enlarged top plan view of the crane of FIG. 1 taken along line 2—2 of FIG. 1, but rotated 90° in clockwise direction from line 2—2, illustrating a particular form of the trolley of the present invention.
Figure 8:
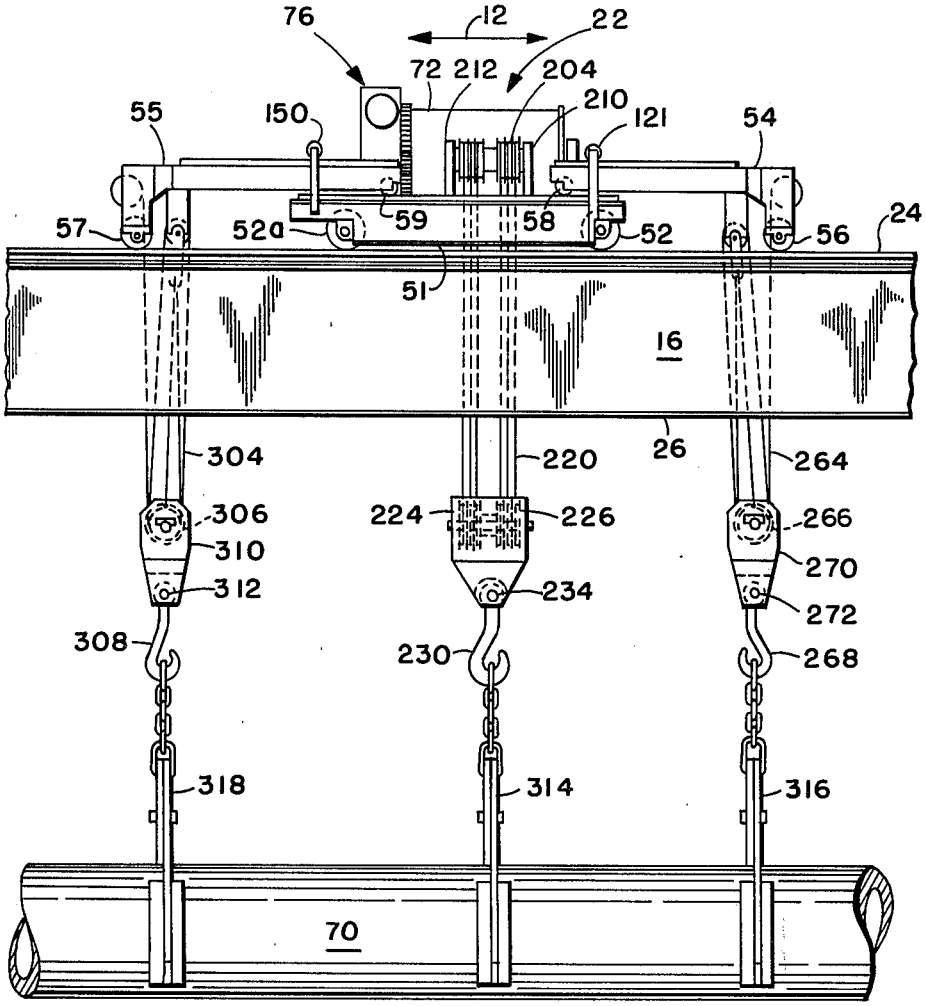
FIG. 8 is a partial elevational view of a crane embodying the present invention in a particular form similar to the view illustrated in FIG. 1, but illustrating the trolley in a horizontally extended mode.

Trolley 22 is driven along tracks 24 by trolley drive assembly 80 which comprises (FIG. 2) electric motor 82 which is mounted on frame member 84 of frame 51 and is rotatably attached to gear reducer 86 by coupling 88. Gear reducer 86 and electrically operated brake 90 are also mounted on frame member 84. Brake 90 engages shaft 92 which projects from gear reducer 86. Motor 82, coupling 88, the upper portion of gear reducer 86, shaft 92 and brake 90 are horizontally disposed on a centerline above drive shaft 94. Gear reducer 86 projects vertically downwardly. Drive shaft 94 is horizontally disposed below motor 82 and rotatably engages gear reducer 86. Mounted on the ends of drive shaft 94 are wheels **52*a*. Drive shaft 94 is rotatably attached to couplings 96 and 98. Motor 82 and brake 90 are activated and controlled from operator cage 50. The rotation of the armature of motor 82 transmits rotational motion to gear reducer 86 which in turn causes drive shaft 94 to rotate and drive wheels 52*a*. The rotation of the armature in one direction drives trolley 22 from left to right along bridge 16 as illustrated in FIGS. 1 or 8, the rotation of the armature in the opposite direction drives the trolley from right to left. The movement of trolley 22 is slowed or stopped by the activation of brake 90. The movement of trolley 22 beyond the edges of bridge 16 is prevented by bumper stops 100 and 102 (FIG. 1) which are welded or bolted to girders 26 and 28**.

Figures 3, 4:
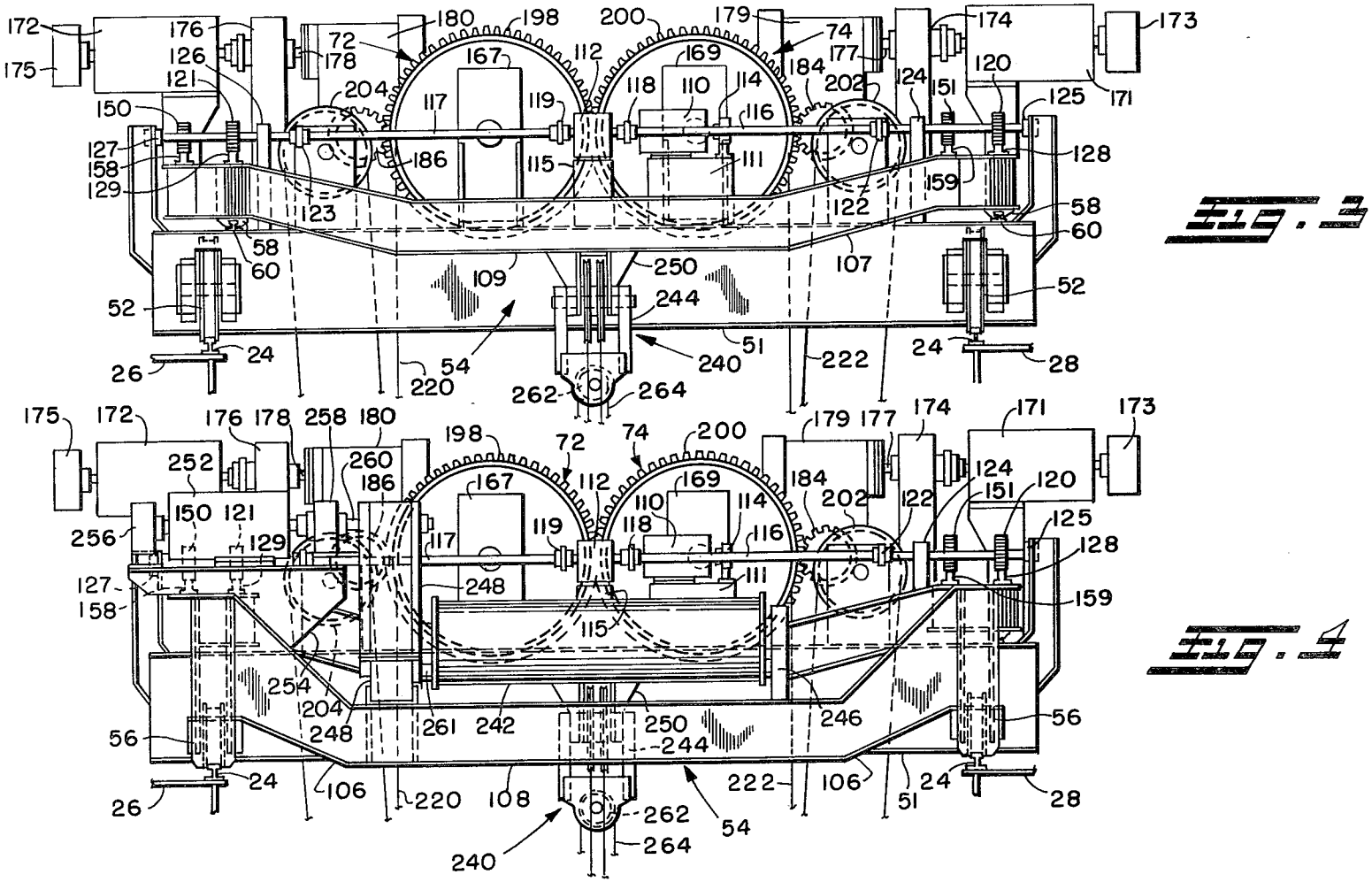
FIG. 3 is a side elevational view of the trolley of FIG. 2 taken along line 3—3 of FIG. 2.
FIG. 4 is a side elevational view of the trolley of FIG. 2 taken along line 4—4 of FIG. 2.

Trailer frame 54 (FIGS. 2 to 4) has a pair of horizontally elongated, parallel spaced frame members 104 and 105 that extend in the direction indicated by directional arrow 12 and are supported on the top of frame 51 by wheels 58. Wheels 58 are rotatably attached to members 104 and 105 and are adapted for travel along tracks 60. Frame members 104 and 105 are connected to each other by underslung beams 106 and 107. Beams 106 and 107 are spaced parallel to each other and are welded to frame members 104 and 105. Beams 106 and 107 project initially inwardly from frame members 104 and 105 at downward sloping angles to underslung horizontally disposed center portions 108 and 109, respectively. Center portions 108 and 109 are spaced parallel to each other. Center portion 108 is disposed in a lower horizontal plane than center portion 109.

The sliding movement of trailer frame 54 is accomplished by the activation and control of drive assembly 78. Drive assembly 78 comprises electric motor 110 which is mounted on support member 111 which is welded to and projects upwardly from frame 51. Motor 110 is rotatably attached to gear reducer 112 by coupling 113. Motor 110 is also rotatably attached to electric brake 114 which is mounted on support member 111. Gear reducer 112 is mounted on support member 115 which is welded to and projects upwardly of frame 51. Drive shafts 116 and 117 project horizontally outwardly from gear reducer 112 and are attached to gear reducer 112 by couplings 118 and 119, respectively. Drive shafts 116 and 117 are disposed in parallel spaced relationship to the centerline of motor 110. Pinion gears 120 and 121 are attached to drive shafts 116 and 117 by couplings 122 and 123, respectively. Pinion gears 120 and 121 are supported by pillow blocks 124 and 125, and 126 and 127, respectively, which contain bearing assemblies to permit the rotational movement of gears 120 and 121. Pillow blocks 124, 125, 126 and 127 are bolted to and project upwardly from frame 51. Pinion gears 120 and 121 are aligned with and rotatably engage horizontally elongated rack gears 128 and 129, respectively. Rack gears 128 and 129 are mounted on and extend horizontally along the upper surface of frame members 104 and 105, respectively, of frame 54. The rotation of the armature of motor 110 transmits rotational movement to gear reducer 112 which in turn induces the rotation of drive shafts 116 and 117 resulting in the rotation of pinion gears 120 and 121. The rotation of the armature in one direction causes the pinion gears to rotate in clockwise direction, while the rotation of the armature in the opposite direction causes the pinion gears to rotate in counterclockwise direction. The clockwise rotation of pinion gears 120 and 121 results in a retracting movement of frame 54, while a counterclockwise movement of pinion gears 120 and 121 results in an extending movement of frame 54. The rotational movement of gears 120 and 121 is reduced or stopped by the activation of brake mechanism 114. When frame 54 is extended for operation in the mode illustrated in FIG. 8 or retracted for operation in the mode illustrated in FIG. 1, it is locked in place by the locking of brake mechanism 114. The inward and outward movement of frame 54 is limited by mechanical stops, and limit switches (not shown) which deactivate motor 110 when frame 54 reaches a predetermined inward or outward position.

Figure 5:
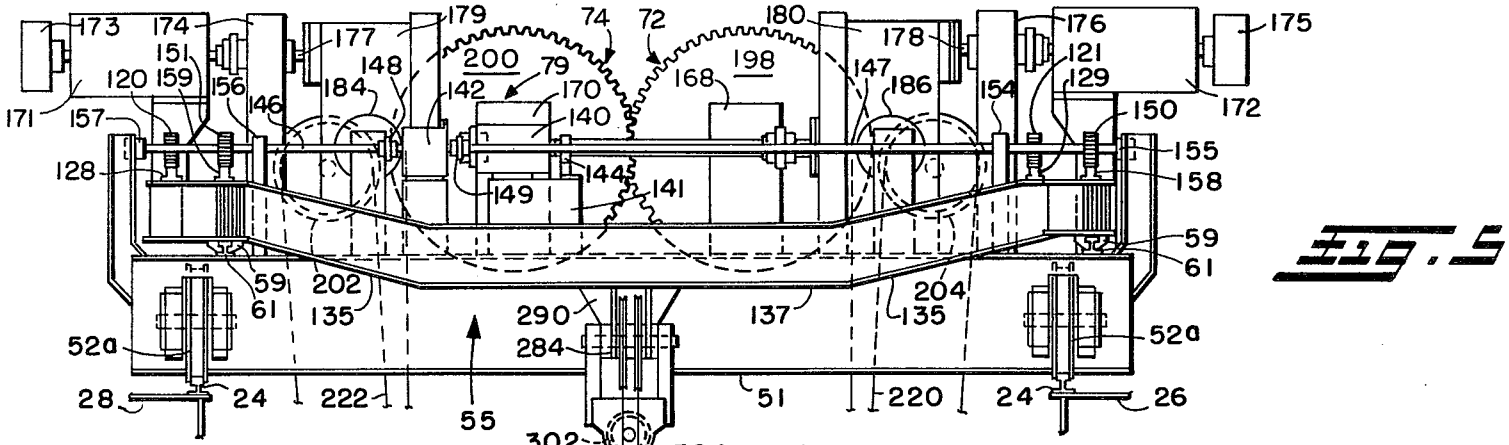
FIG. 5 is a side elevational view of the trolley of FIG. 2 taken along line 5—5 of FIG. 2.
Figure 6:
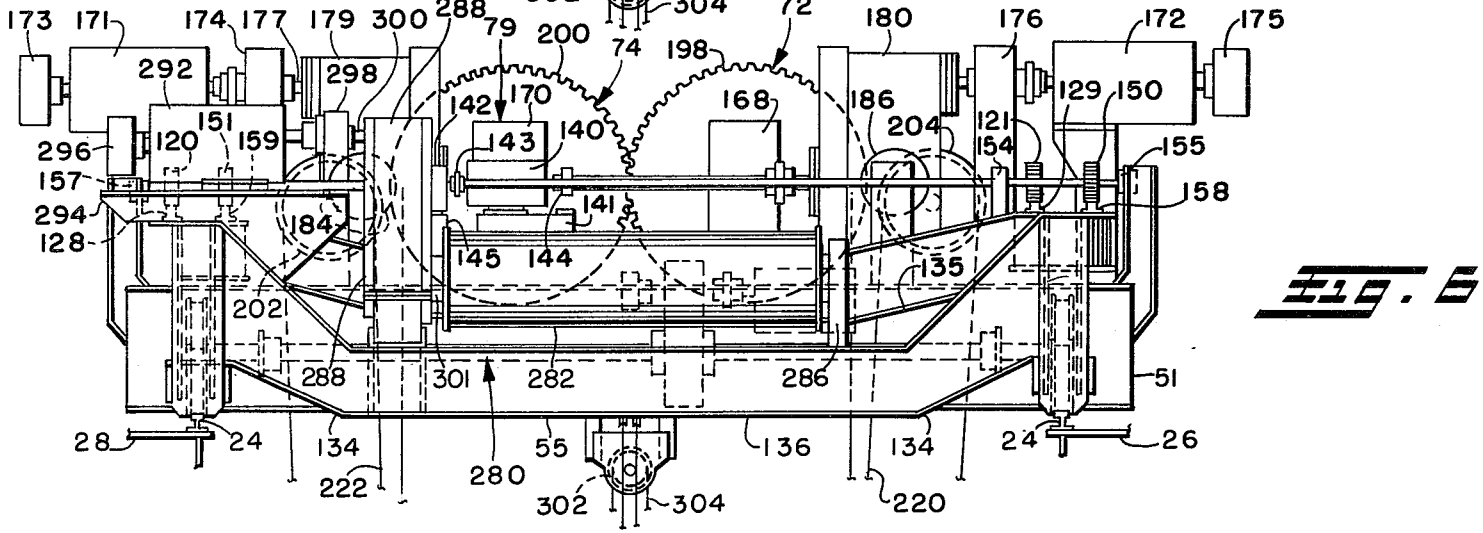
FIG. 6 is a side elevational view of the trolley of FIG. 2 taken along line 6—6 of FIG. 2.

Trailer frame 55 (FIGS. 2, 5 and 6) has a pair of horizontally elongated, parallel spaced frame members 132 and 133 that extend in the direction indicated by directional arrow 12 and are supported on the top of frame 51 by wheels 59. Wheels 59 are rotatably attached to members 132 and 133 and are adapted for travel along tracks 61. Frame members 132 and 133 are connected to each other by underslung beams 134 and 135. Beams 134 and 135 are spaced parallel to each other and are welded to frame members 132 and 133. Beams 134 and 135 project initially inwardly from frame members 132 and 133 at downward sloping angles to underslung horizontally disposed center portions 136 and 137, respectively. Center portions 136 and 137 are spaced parallel to each other. Center portion 136 is disposed in a lower horizontal plane than center portion 137.

The sliding movement of trailer frame 54 is accomplished by the activation and control of drive assembly 79. Drive assembly 79 comprises electric motor 140 which is mounted on support member 141 which is welded to and projects upwardly from frame 51. Motor 140 is rotatably attached to gear reducer 142 by coupling 143. Motor 140 is also rotatably attached to electric brake 144 which is mounted on support member 141. Gear reducer 142 is mounted on support member 145 which is welded to and projects upwardly of frame 51. Drive shafts 146 and 147 project horizontally outwardly from gear reducer 142 and are attached to gear reducer 142 by couplings 148 and 149, respectively. Drive shafts 146 and 147 are disposed in parallel spaced relationship to the centerline of motor 140. Pinion gears 150 and 151 are attached to drive shafts 146 and 147, respectively. Pinion gears 150 and 151 are supported by pillow blocks 154 and 155, and 156 and 157, respectively, which contain bearing assemblies to permit the rotational movement of gears 150 and 151. Pillow blocks 154, 155, 156 and 157 are bolted to and project upwardly from frame 51. Pinion gears 150 and 151 are aligned with and rotatably engage rack gears 158 and 159, respectively. Rack gears 158 and 159 are mounted on and extend horizontally along the upper surface of frame members 132 and 133, respectively, of frame 55. The rotation of the armature of motor 140 transmits rotational movement to gear reducer 142 which in turn induces the rotation of drive shafts 146 and 147 resulting in the rotation of pinion gears 150 and 151. The rotation of the armature in one direction causes the pinion gears to rotate in clockwise direction, while the rotation of the armature in the opposite direction causes the pinion gears to rotate in counterclockwise direction. The clockwise rotation of pinion gears 150 and 151 results in a retracting movement of frame 55, while a counterclockwise movement of pinion gears 150 and 151 results in an extending movement of frame 55. The rotational movement of gears 150 and 151 is reduced or stopped by the activation of brake mechanism 144. When frame 55 is extended for operation in the mode illustrated in FIG. 8 or retracted for operation in the mode illustrated in FIG. 1, it is locked in place by the locking of brake mechanism 144. The inward and outward movement of frame 55 is limited by mechanical stops, and limit switches (not shown) which deactivate motor 140 when frame 55 reaches a predetermined inward or outward position.

Trailer frames 54 and 55 are disposed in the same horizontal plane. Frame member 105 of frame 54 is disposed inwardly of frame member 132 of frame 55. Frame member 104 of frame 54 is disposed outwardly of frame member 133 of frame 55. Frame 54 includes offset sections 160 and 161 to align wheels 56 with tracks 24. Similarly, frame 55 includes offset sections 162 and 163 to align wheels 57 with tracks 24. Frames 54 and 55 are extended and retracted independently of each other. Thus while both frames 54 and 55 are illustrated as fully retracted (FIG. 1) and fully extended (FIG. 8), it is possible and under various circumstances advantageous to operate with either frame 54 or 55 in a partially or fully extended mode while the other is operated in a partially or fully retracted mode.

Lifting barrels 72 and 74 (FIG. 2) are rotatably mounted on pillow blocks 167 and 168, and 169 and 170, respectively, which are bolted to and project upwardly from frame 51. The center axes of barrels 72 and 74 are disposed parallel to each other in spaced relationship. Barrels 72 and 74 are rotated by drive assembly 76. Drive assembly 76 comprises electric motors 171 and 172 which are mounted on frame 51. Motors 171 and 172 are connected to electrically operated brake mechanisms 173 and 174, and 175 and 176, respectively. Each brake mechanism 173, 174, 175 and 176 is mounted on frame 51 and is designed to reduce or stop the rotation of barrels 72 and 74 and, optionally, lock the barrels in place during the transport of craneloads. Each motor 171 and 172 employs two brakes to provide an added measure of safety. Thus, while one brake on each motor is adequate under various advantageous conditions, two are preferred. Shafts 177 and 178 provide horizontally from brakes 174 and 176, are rotated by motors 171 and 172, and rotatably engage worm reducers 179 and 180, respectively. Drive shafts 181 and 182 project from worm reducers 179 and 180, respectively, at right angles to the center line of line shafts 177 and 178 and are connected to pinion gears 184 and 186, respectively. Drive shafts 181 and 182 are rotatably supported by bearings 188 and 190, respectively, which are mounted on frame 51. Shafts 177 and 178 project from worm reducers 179 and 180 and are connected to line shaft 192 by couplings 194 and 196. The connection at line shaft 192 mechanically synchronizes motors 171 and 172 to insure that the rates of rotation of such motors are equal. Gears 184 and 186 rotatably engage gears 198 and 200 which are mounted on the ends of barrels 72 and 74, respectively. Gears 198 and 200 are operated with zero backlash. The rotation of gears 198 and 200 is timed so that the gear teeth of one does not touch the gear teeth of the other during normal operation. In the event, however, that one or more components in the drive assembly of either barrel 72 or 74 should fail, the gear teeth of gears 198 and 200 would engage each other so that the functioning drive assembly would drive both barrels 72 and 74 to prevent an unbalancing of the load being carried by the crane. Barrel 72 rotates in a clockwise direction when barrel 74 rotates in counterclockwise direction, and vice versa. Upper sheaves 202 and 204 are rotatably mounted on bearing blocks 206 and 208, and 210 and 212, respectively, with their axes of rotation spaced parallel to the axes of rotation of barrels 72 and 74. Bearing blocks 206, 208, 210 and 212 are welded to and project upwardly from frame 51.

Figure 7:
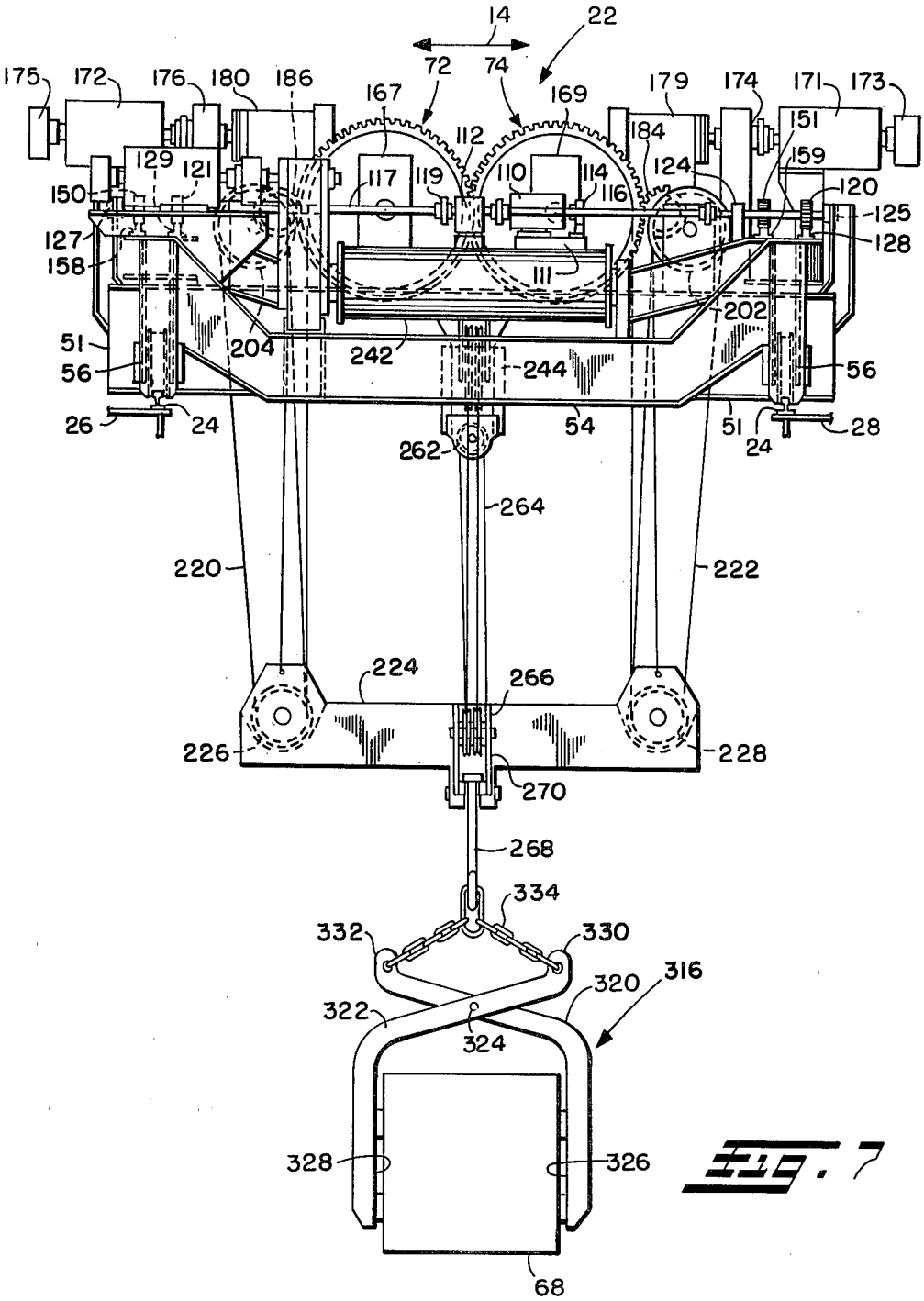
FIG. 7 is a side elevational view of the crane of FIG. 1 taken along line 7—7 of FIG. 1.

Depending from barrel 72 and upper sheave 204 are ropefalls 220 (FIG. 7). Likewise, depending from barrel 74 and upper sheave 202 are ropefalls 222. Ropefalls 220 and 222 are disposed between girders 26 and 28. Suspended by ropefalls 220 and 222 is lifting beam 224. The ropefalls, lifting barrels and upper sheaves are arranged so that the load hoisted and carried by trolley 22 is centrally distributed evenly over girders 26 and 28. Each ropefall 220 and 222 preferably comrises fourteen wire ropes, seven of the ropes being coiled in right-handed grooves in each of the barrels 72 and 74, respectively, and the other seven being coiled in lefthanded grooves in each of the respective barrels. Additional wire ropes or fewer wire ropes can be utilized with each ropefall, the number and design of such ropes being dependent upon the anticipated loads to be hoisted. Rotatably attached to lifting beam 224 are hoisting sheaves 226 and 228 which are attached to ropefalls 220 and 222, respectively. Depending from lifting beam 224 is hook 230 (FIGS. 1 and 8) which is pivotally attached to lifting beam 224 by pin 234. Ropes 220 drop from barrel 72 (FIG. 7) to hoisting sheave 226, wrap around sheave 226, extend upwardly to sheave 204, wrap around sheave 204, continue for the necessary number of falls and ultimately return to beam 224 where they dead end. Similarly, ropes 222 drop from barrel 74 to hoisting sheave 228, wrap around sheave 228, extend upwardly to sheave 202, wrap around sheave 202, continue for the necessary number of falls and ultimately return to beam 224 where they dead end. The dead ends of ropes 220 and 222 are attached to lifting beam 224 with an equalizer beam (not shown). The winding or unwinding of ropes 220 and 222 on barrels 72 and 74, respectively, result in a consequent shortening or lengthening of ropefalls 220 and 222 to lift or lower lifting beam 224. Alternatively, for relatively small cranes or for cranes wherein the crane loads are anticipated to be relatively light, a single lifting-barrel-upper-sheave hoist could be employed in place of the foregoing arrangement.

A first auxiliary hoist which is indicated generally by the reference 240 and mounted on trailer frame 54 comprises (FIGS. 2 to 4) auxiliary lifting barrel 242 and auxiliary upper sheave 244. Lifting barrel 242 is rotatably supported by pillow block 246 and gear reducer 248. Pillow block 246 is bolted to and projects upwardly from underslung beam 106. Pillow block 246 contains a bearing assembly that permits barrel 242 to rotate. Gear reducer 248 is mounted on and projects upwardly from beam 106. Upper sheave 244 is rotatably mounted on bracket 250 which depends from and is welded to the bottom of underslung beam 107. The center axes of barrel 242 and sheave 244 are spaced parallel to each other with the center axis of sheave 244 being disposed in a lower plane than the center axis of barrel 242. Barrel 242 is driven by electric motor 252. Motor 252 is mounted on support member 254 which is welded to the top of beam 106. Motor 252 is connected to electrically operated brake mechanisms 256 and 258. Brake 256 is mounted on support member 254 in the rear of motor 252 and engages the armature of motor 252. Brake 258 is mounted on support member 254 in front of motor 252 and also engages the armature of motor 252. Brakes 256 and 258 are disposed on a center line with motor 252. Brakes 256 and 258 are employed to reduce or to stop the rotation of barrel 242 and, optionally, lock the barrel in place during the transport of crane loads. Two brakes are provided as an added measure of safety. While one brake is adequate under various advantageous conditions, two are preferred. Shaft 260 projects from gear reducer 248 and engages brake 258. Gear reducer 248 engages drive shaft 261 which is attached to barrel 242. The rotation of the armature of motor 252 transmits rotational movement to gear reducer 248 which in turn causes barrel 242 to rotate.

Rotatably attached to the housing of upper sheave 244 is equalizer sheave 262. Depending from drum 242, upper sheave 244 and equalizer sheave 262 are ropefalls 264 which suspend hoisting sheave 266 which is rotatably mounted in housing 270. (FIGS. 1, 7 and 8). Auxiliary hook 268 is pivotally attached to housing 270 by pin 272 and depends from housing 270. Ropefall 264 preferably comprises eight wire ropes. Four of the ropes are coiled in right-handed grooves in barrel 242 and the other four are coiled in the left-handed grooves in barrel 242. Additional wire ropes or fewer wire ropes can be utilized with ropefall 264, the number and design of such wire ropes being dependent upon the anticipated loads to be hoisted. Ropes 264 project from drum 242, drop to sheave 266, wrap around sheave 266, extend upwardly to sheave 244, wrap around sheave 244, drop to sheave 266, wrap around sheave 266, extend upwardly up to equalizer sheave 262, continue for the necessary number of falls, and ultimately return to sheave 266. Both ends of ropes 264 dead end on barrel 242. Equalizer sheave 262 provides for equalized reeving. The rotation of lifting barrel 242 results in a consequent shortening or lengthening of ropefalls 264 to lift or lower auxiliary hook 268.

A second auxiliary hoist which is indicated generally by the reference 280 and mounted on trailer frame 55 comprises (FIGS. 2, 5 and 6) auxiliary lifting barrel 282 and auxiliary upper sheave 284. Lifting barrel 282 is rotatably supported by pillow blocks 286 and gear reducer 288. Pillow block 286 is bolted to and projects upwardly from underslung beam 134. Pillow block 286 contains a bearing assembly that permits barrel 282 to rotate. Gear reducer 288 is mounted on and projects upwardly from beam 134. Upper sheave 284 is rotatably mounted on bracket 290 which depends from and is welded to the bottom of underslung beam 135. The center axes of barrel 282 and sheave 284 are spaced parallel to each other with the center axis of sheave 284 being disposed in a lower plane than the center axis of barrel 282. Barrel 282 is driven by electric motor 292. Motor 292 is mounted on support member 294 which is welded to the top of beam 134. Motor 292 is connected to electrically operated brake mechanisms 296 and 298. Brake 296 is mounted on bracket 294 in the rear of motor 292 and engages the armature of motor 292. Brake 298 is mounted on support member 294 in front of motor 292 and also engages in the armature of motor 292. Brakes 296 and 298 are disposed on a center line with motor 292. Brakes 296 and 298 are employed to reduce or to stop the rotation of barrel 282 and, optionally, lock the barrel in place during the transport of crane loads. Two brakes are provided as an added measure of safety. While one brake is adequate under various advantageous conditions, two are preferred. Shaft 300 projects from gear reducer 288 and engages brake 298. Gear reducer 288 engages drive shaft 301 which is attached to barrel 282. The rotation of the armature of motor 292 transmits rotational movement to gear reducer 288 which in turn causes barrel 282 to rotate. Rotatably attached to the housing of upper sheave 284 is equalizer sheave 302. Depending from drum 282, upper sheave 284 and equalizer sheave 302 are ropefalls 304 which suspend hoisting sheave 306 which is rotatably mounted in housing 310, (FIGS. 1 and 8). Auxiliary hook 308 is pivotally attached to housing 310 by pin 312 and depends from housing 310. Ropefall 304 preferably comprises eight wire ropes. Four of the ropes are coiled in right-handed grooves in barrel 282 and the other four are coiled in the left-handed grooves in barrel 282. Additional wire ropes or fewer wire ropes can be utilized with ropefall 304, the number and design of such wire ropes being dependent upon the anticipated loads to be hoisted. Ropes 304 project from drum 282, drop to sheave 306, wrap around sheave 306, extend upwardly to sheave 284, wrap around sheave 284, drop to sheave 306, wrap around sheave 306, extend upwardly up to equalizer sheave 302, continue for the necessary number of falls, and ultimately return to sheave 306. Both ends of ropes 304 dead end on barrel 282. Equalizer sheave 302 provides for equalized reeving. The rotation of lifting barrel 282 results in a consequent shortening or lengthening of ropefalls 304 to lift or lower auxiliary hook 308.

Grab assemblies 314, 316 and 318 (FIGS. 1, 7 and 8) are suspended by hooks 230, 268 and 308, respectively, and are entirely conventional in design, construction and operation. Grab assemblies 314, 316 and 318 are identical in design and, accordingly, it is only necessary to describe the design and operation of grab assembly 316, such description being applicable to grab assemblies 314 and 318. Grab assembly 316 (FIG. 7) is a scissors assembly comprising a pair of criss-crossing arm members 320 and 322 which are pivotally connected to each other by pin 324. Formed on the lower portions of arms 320 and 322 are opposed complemental tongs 326 and 328 that are adapted for grabbing or engaging the article to be lifted. Connected to the upper portions 330 and 332 of arms 322 and 320, respectively, is chain 334 which is adapted for attachment to hook 268. In operation, the upward movement of hook 268 causes tension to be exerted on chain 334 and a consequent inward or closing movement of upper portions 330 and 332 and tongs 326 and 328.

It is to be understood that any grab assembly or lifting attachment that can be suspended for hoisting operations can be used in combination with the trolley of the present invention. In this regard, the design of hooks 230, 268 and 308 can be modified to accommodate the particular grab assembly that is to be used. The selection of the grab assembly to be used is dependent upon the size and shape of the articles to be hoisted. Grab assemblies that can be used in combination with the trolley of the present invention include, inter alia: sheet and plate handling assemblies such as, for example, parallelogram type sheet and plate lifters, sliding leg type sheet lifters or leg type sheet pack lifters; roll handling devices such as, for example, end grip roll grab assemblies; vacuum lifters such as, for example, vacuum plate lifters or single pad vacuum lifters; mechanical tongs such as, for example, slab and ingot tongs, single point ingot tongs, ingot swivel tongs, drum lifters or unequal leg tone assemblies; coil handling assemblies such as, for example, balanced "C" hook plate type assemblies, parallelogram coil grab assemblies, coil lifting hook assemblies or motor operated coil grab mechanical grip assemblies, and electromagnets.

Trolley 22 is operated in its retracted mode (FIG. 1) when it is used for hoisting and transporting relatively compact articles such as, for example, box 68. In operation, bridge 16 moves along track 18 and trolley 22 moves along tracks 24 until grab assemblies 314, 316 and 318 are suspended over box 68. Grab assembly 314 is lowered by the activation of drive assembly 76 to rotate barrels 72 and 74 until grab assembly 314 is in sufficiently close proximity to box 68 for attachment. Grab assemblies 316 and 318 are lowered by the rotation of lifting barrels 242 and 282, respectively, until grab assemblies 316 and 318 are in sufficiently close proximity to box 68 for attachment. Grab assemblies 314, 316 and 318 are attached to box 68. Box 68 is hoisted by the rotation of barrels 72 and 74 which moves hook 230 and grab assembly 314 upwardly. Similarly, barrels 242 and 282 are rotated to raise hooks 268 and 308, and, consequently, grab assemblies 316 and 318, upwardly. The upward movement of grab assemblies 314, 316 and 318 is synchronized by electrical controls (not shown) to insure a stabilized hoisting. The upward hoisting movement of hooks 230, 268 and 308 induces a positive gripping action by grab assemblies 314, 316 and 318 on box 68. With the upward hoisting of box 68, bridge 16 is moved along tracks 18 and trolley 22 is moved along tracks 24 until box 68 is suspended over its point of destination. Upon reaching the point of destination which may be, for example, the hold of a ship or the storage area of a warehouse, box 68 is lowered by the rotation of barrels 72 and 74, and barrels 242 and 282 until box 68 reaches its point of destination. Upon reaching its point of destination, grab assemblies 314, 316 and 318 are disconnected.

Trolley 22 is operated in its extended mode (FIG. 8) when it is used for hoisting and transporting elongated articles such as, for example, elongated tubular article 70. Trolley 22 is adjusted to operate in its extended mode by the activation of drive assemblies 78 and 79 which slide trailer frames 54 and 55, respectively, outwardly from the position illustrated in FIG. 1 to the position illustrated in FIG. 8. Bridge 16 moves along tracks 18 and trolley 22 moves along tracks 24 until grab assemblies 314, 316 and 318 are suspended over article 70. Grab assembly 314 is lowered by the activation of drive assembly 76 to rotate barrels 72 and 74 until grab assembly 314 is in sufficiently close proximity to article 70 for attachment. Grab assemblies 316 and 318 are lowered by the rotation of lifting barrels 242 and 282, respectively, until grab assemblies 316 and 318 are in sufficiently close proximity to article 70 for attachment. Grab assemblies 314, 316 and 318 are attached to article 70. Article 70 is hoisted by the rotation of barrels 72 to 74 which moves hook 230 and grab assembly 314 upwardly. Similarly, barrels 242 and 282 are rotated to raise hooks 268 and 308 and, consequently, grab assemblies 316 and 318, upwardly. The upward movement of grab assemblies 314, 316 and 318 is synchronized to assure a stabilized hoisting. The upward hoisting movement of hooks 230, 268 and 308 induces a positive gripping action by the grab assemblies 314, 316 and 318 on article 70. With the upward hoisting of article 70, bridge 16 is moved along tracks 18 and trolley 22 is moved along tracks 24 until article 70 is suspended over its point of destination. Upon reaching the point of destination article 70 is lowered by the rotation of barrels 72 and 74, and barrels 242 and 282 and until article 70 reaches its point of destination. Upon reaching its point of destination grab assemblies 314, 316 and 318 are disconnected.

Under various advantageous conditions, trolley 22 can be operated with one of the trailer frames 54 or 55 disposed in its fully extended mode and the other trailer frame disposed in its fully retracted mode. Alternatively, one of the trailer frames 54 or 55 can be operated in a partially extended mode while the other trailer frame is operated in either a fully or partially extended or a fully or partially retracted mode. The selection of the particular mode or combination of modes of operation for each trailer frame is dependent upon the size and shape of the article to be hoisted and transported. Similarly, it may be preferably to employ only one or two of the three hoists of trolley 22. Under such circumstances, the hoist(s) not being used are preferably carried with the lifting hook(s) of such hoist(s) hoisted to a point where they will not interfere with the operation of the hoist(s) being used. Alternatively, more than one article can be carried by trolley 22 at one time. For example, grab assemblies 314 and 316 can be used to hoist and transport one article, while grab assembly 318 is used to hoist and transport another article. Similarly, three articles could be hoisted and transported at one time, one of such articles being carried by each of the grab assemblies 314, 316 and 318. The larger or heavier articles are advantageously hoisted and transported by grab assembly 314 since the hoisting mechanism for grab assembly 314 is adapted for handling heavier loads than the hoisting mechanism for grab assemblies 316 and 318.

An advantage of employing the multifunctional, two-way, extendable trolley of the present invention is that both relatively compact articles, such as box 68, and elongated articles, such as tubular article 70, can be hoisted and transported with a single trolley and, consequently, a single crane. The disadvantages of using a crane employing two or more separate trolleys or two or more separate cranes are thus avoided.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A two-way extendable trolley comprising a trolley frame and wheel means for supporting said trolley frame, said wheel means being adapted for travel along primary track means, means for driving said wheel means along said primary track means, hoisting means mounted on said trolley frame, a first horizontally elongated trailer frame slidably mounted on said trolley frame, said first trailer frame having a first end extending beyond a first end of said trolley frame, first auxiliary wheel means for supporting said first end of said first trailer frame, said first auxiliary wheel means being adapted for travel along said primary track means, a first auxiliary hoisting means mounted on said first trailer frame, and means for horizontally extending said first trailer frame outwardly from said trolley frame and retracting said first trailer frame inwardly toward said trolley frame, and a second horizontally elongated trailer frame slidably mounted on said trolley frame, said second trailer frame having a first end extending beyond a second end of said trolley frame, second auxiliary wheel means for supporting said first end of said second trailer frame, said second auxiliary wheel means being adapted for travel along said primary track means, a second auxiliary hoisting means mounted on said second trailer frame, means for horizontally extending said second trailer frame outwardly from said trolley frame and retracting said second trailer frame inwardly toward said trolley frame, said first trailer frame and second trailer frame being adapted for extending in opposite directions for each other.

2. The trolley of claim 1 wherein said first and said second trailer frames are disposed in the same horizontal plane.

3. The trolley of claims 1 or 2 wherein said first trailer frame is mounted on a first set of wheels that are adapted for travel on a first pair of horizontally elongated parallel spaced tracks mounted on said trolley frame, and said second trailer frame is mounted on a second set of wheels that are adapted for travel on a second pair of horizontally elongated parallel spaced tracks mounted on said trolley frame.

4. The trolley of claims 1 or 2 wherein said trolley frame comprises a horizontally elongated rectangular frame.

5. The trolley of claims 1 or 2 wherein said first and said second trailer frames each comprise a pair of horizontally elongated parallel spaced frame members connected to each other by cross-member means.

6. The trolley of claim 5 wherein said cross-member means of said first trailer frame comprises a first pair of horizontally elongated parallel spaced underslung beams fixedly attached to and disposed at right angles to the frame members of said first trailer frame, and said cross-member means for said second trailer frame comprises a second pair of horizontally elongated parallel spaced underslung beams fixedly attached to and disposed at right angles to the frame members of said second trailer frame.

7. The trolley of claim 1 wherein said means for extending and retracting said first and second trailer frames comprises a first horizontally elongated rack gear mounted on said first trailer frame and a first pinion gear supported by said trolley frame, said first pinion gear being adapted for engaging said first rack gear, and means for rotating said first pinion gear, and a second horizontally elongated rack gear mounted on said second trailer frame and a second pinion gear supported by said trolley frame, said second pinion gear being adapted for engaging said second rack gear, and means for rotating said second pinion gear.

8. The trolley of claim 1 wherein said hoisting means comprises a pair of lifting barrels and a pair of upper sheaves rotatably mounted on said trolley frame, said lifting barrels being horizontally aligned in spaced parallel relationship to said upper sheaves, and means for rotating said lifting barrels.

9. The trolley of claim 1 wherein said first auxiliary hoisting means comprises a first auxiliary lifting barrel and a first auxiliary upper sheave rotatably mounted on said first trailer frame and means for rotating said first auxiliary lifting barrel, and said second auxiliary hoisting means comprises a second auxiliary lifting barrel and a second auxiliary upper sheave rotatably mounted on said second trailer frame and means for rotating said second auxiliary lifting barrel.

10. The trolley of claim 1 wherein said wheel means comprises a plurality of wheels rotatably attached to said trolley frame and said means for driving said wheel means comprises an electric motor and a gear reducer rotatably connected to each other and mounted on said trolley frame, and a drive shaft rotatably attached to said gear reducer, at least one of said wheels being connected to said drive shaft.

11. A crane comprising a horizontally elongated bridge, means for supporting said bridge, and a two-way extendable trolley mounted on said bridge and adapted for horizontal travel along said bridge, said trolley including a trolley frame, wheel means for supporting said trolley frame, a first horizontally elongated trailer frame slidably mounted on said trolley frame, said trailer frame having a first end extending beyond a first end of said trolley frame and first auxiliary wheel means for supporting said first end of said first trailer frame, and a second horizontally elongated trailer frame slidably mounted on said trolley frame, said second trailer frame having a first end extending beyond a second end of said trolley frame and second auxiliary wheel means for supporting said first end of said second trailer frame, said first end and said second end of said trolley frame being disposed opposite each other, said first trailer frame and said second trailer frame being adapted for extending in opposite directions from each other.

12. The crane of claim 11 with means for horizontally extending said first trailer frame and said second trailer frame outwardly from said trolley frame and retracting said first trailer frame and said second trailer frame inwardly toward said trolley frame.

13. The crane of claim 12 wherein said means for extending and retracting said first and said second trailer frames comprises a first horizontally elongated rack gear mounted on said first trailer frame and a first pinion gear supported by said frame means, said first pinion gear being adapted for engaging said first rack gear and means for rotating said first pinion gear, and a second horizontally elongated rack gear mounted on said second trailer frame and a second pinion gear supported by said trolley frame, said second pinion gear being adapted for engaging said second rack gear and means for rotating said second pinion gear.

14. The crane of claim 11 with hoisting means mounted on said trolley frame.

15. The crane of claim 14 wherein said hoisting means comprises a pair of lifting barrels and a pair of upper sheaves rotatably mounted on said trolley frame, said lifting barrels being horizontally aligned in spaced parallel relationship to said upper sheaves, and means for rotating said lifting barrels.

16. The crane of claim 14 with a plurality of primary ropefalls depending from said hoisting means.

17. The crane of claim 16 with a lifting beam suspended by said plurality of primary ropefalls.

18. The crane of claim 17 wherein said lifting beam comprises a horizontally elongated member suspended by said primary ropefalls and a main lifting hook depending from said elongated member.

19. The crane of claim 11 with a first auxiliary hoisting means mounted on said first trailer frame and a second auxiliary hoisting means mounted on said second trailer frame.

20. The crane of claim 19 wherein said first auxiliary hoisting means comprises a first auxiliary lifting barrel and a first auxiliary upper sheave rotatably mounted on said first trailer frame and means for rotating said first auxiliary lifting barrel, and said second auxiliary hoisting means comprises a second auxiliary lifting barrel and a second auxiliary upper sheave rotatably mounted on said second trailer frame and means for rotating said second auxiliary lifting barrel.

21. The crane of claim 19 with a first plurality of auxiliary ropefalls depending from said first auxiliary hoisting means and a second plurality of auxiliary ropefalls depending from said second auxiliary hoisting means.

22. The crane of claim 21 with a first auxiliary hook suspended by said first plurality of auxiliary ropefalls and a second auxiliary hook suspended by said second plurality of auxiliary ropefalls.

23. The crane of claim 11 with means for driving said trolley frame along a first pair of horizontally elongated parallel spaced tracks mounted on said bridge.

24. The crane of claim 11 wherein said first trailer frame is mounted on wheels that are adapted for travel on a first pair of horizontally elongated parallel spaced auxiliary tracks mounted on said trolley frame, and said second trailer frame is mounted on wheels that are adapted for travel on a second pair of horizontally elongated parallel spaced auxiliary tracks mounted on said trolley frame.

25. The crane of claim 11 wherein said trolley frame comprises a horizontally elongated rectangular frame.

26. The crane of claim 11 wherein said first and said second trailer frames each comprise a pair of horizontally elongated parallel spaced frame members connected to each other by cross member means.

27. The crane of claim 26 wherein said cross member means for said first trailer frame comprises a first pair of horizontally elongated parallel spaced underslung beams fixedly attached to and disposed at right angles to the frame members of said first trailer frame, and said cross member means for said second trailer frame comprises a second pair of horizontally elongated parallel spaced underslung beams fixedly attached to and disposed at right angles to the frame members of said second trailer frame.

28. The crane of claim 11 wherein said means for supporting said bridge comprises a pair of horizontally elongated tracks mounted on the ground and said bridge is mounted on vertically elongated trestles that are mounted for travel along said tracks.

29. The crane of claim 11 wherein said means for supporting said bridge comprises a pair of horizontally elongated parallel spaced tracks mounted overhead.

30. The crane of claim 11 wherein said means for supporting said bridge comprises an arcuate track.

31. The crane of claim 11 with an operator cage depending from said bridge.

32. The crane of claim 11 wherein said bridge comprises a horizontally elongated rectangular frame comprising a pair of horizontally elongated girders connected by end-ties, said girders being sufficiently elongated to traverse the ground or floor area being serviced by said crane, said end-ties being sufficiently elongated to provide said bridge with structural stability and to provide a sufficiently open area between said girders to allow for the movement and operation of said trolley.

* * * * *